US010199754B2

(12) United States Patent
Ishimatsu et al.

(10) Patent No.: US 10,199,754 B2
(45) Date of Patent: Feb. 5, 2019

(54) CONNECTOR AND CONNECTOR-EQUIPPED CABLE

(71) Applicant: Hitachi Metals, Ltd., Tokyo (JP)

(72) Inventors: Yosuke Ishimatsu, Tokyo (JP); Izumi Fukasaku, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/883,201

(22) Filed: Jan. 30, 2018

(65) Prior Publication Data

US 2018/0233838 A1 Aug. 16, 2018

(30) Foreign Application Priority Data

Jan. 30, 2017 (JP) ..... 2017-013949

(51) Int. Cl.
*H01R 13/73* (2006.01)
*H01R 12/53* (2011.01)
*H01R 12/71* (2011.01)

(52) U.S. Cl.
CPC ..... *H01R 12/53* (2013.01); *H01R 12/714* (2013.01)

(58) Field of Classification Search
CPC .. H01R 23/668; H01R 13/748; H01R 23/684; H01R 23/7068; H01R 23/725; H01R 23/688; H02K 5/225
USPC ..... 439/495, 564, 260, 926, 59, 108, 74
See application file for complete search history.

(56) References Cited

U.S. PATENT DOCUMENTS 5,738,545 A * 4/1998 Igarashi ..... H01R 23/662 439/492
5,738,797 A * 4/1998 Belke, Jr. ..... C23F 1/02 216/16
5,885,091 A * 3/1999 Belanger, Jr. ..... H05K 3/326 439/67
5,917,709 A * 6/1999 Johnson ..... H01R 9/096 174/138 G
5,928,003 A * 7/1999 Kajinuma ..... H01R 12/716 439/248
6,135,781 A * 10/2000 Pope ..... H01R 12/716 439/59

FOREIGN PATENT DOCUMENTS

JP H10-335019 A 12/1998

* cited by examiner

*Primary Examiner* — Phuong Chi T Nguyen
(74) *Attorney, Agent, or Firm* — Scully, Scott, Murphy & Presser, P.C.

(57) ABSTRACT

A connector for being arranged at an end of a cable includes a paddle card substrate for electrically connecting the cable to a connected device, plural device-side electrodes that are formed at an end portion of the paddle card substrate in plural rows in an insertion direction into the device and are to be electrically connected to the device, and a protective portion formed between the device-side electrodes adjacent in the insertion direction into the device to protect a surface of the paddle card substrate. The protective portion includes plural metal protective pads that are spaced from each other at a predetermined distance in the insertion direction.

4 Claims, 5 Drawing Sheets

CONNECTOR AND CONNECTOR-EQUIPPED CABLE

The present application is based on Japanese patent application No. 2017-013949 filed on Jan. 30, 2017, the entire contents of which are incorporated herein by reference.

BACKGROUND OF THE INVENTION

1. Field of the Invention

The invention relates to a connector and a connector-equipped cable.

2. Description of the Related Art

Circuit boards provided on so-called IT (Information Technology) devices such as servers or network devices are commonly called "motherboard", and plural connector-equipped cables are connected to the motherboard.

Connector-equipped cable to be used is composed of a cable incorporating plural differential signal transmission cables and connectors provided at both ends of the cable. Each connector incorporates a paddle card substrate for electrically connecting the cable to device such as IT device. Plural device-side electrodes to be electrically connected to the device are formed at an edge of the paddle card substrate.

Along with improved performance of IT devices, it is desired to broaden the transmittable bandwidth of connector-equipped cables. One of the methods to broaden the transmittable bandwidth is to increase the number of channels in a connector-equipped cable. When using this method, it is necessary to increase the number of device-side electrodes on the paddle card substrate. The number of device-side electrodes on the paddle card substrate can be increased when, e.g., device-side electrodes are provided in plural rows as disclosed in JP H10/335019 A.

SUMMARY OF THE INVENTION

FIG. 7 is an explanatory diagram illustrating a prior art disclosed in JP H10/335019 A. FIG. 7 shows an example in which device-side electrodes 40*a* and 40*b* are provided on a paddle card substrate 200 so as to form plural rows at one end. The device-side electrodes 40*a* are provided at a predetermined distance from an end face of the paddle card substrate. The device-side electrodes 40*b* are provided at a farther distance from the end face of the paddle card substrate than the device-side electrodes 40*a*. The paddle card substrate 200 is connected to device such as IT device so that the device-side electrodes 40*a* and 40*b* are respectively in contact with plural contacts 11*a* and 11*b* which are provided inside a connector housing 10 of the device and are electrically connected to a motherboard (not shown). When connecting the paddle card substrate 200 to the device, the paddle card substrate 200 is slid into the connector housing 10 in such a manner that the contacts 11*a* and 11*b* slidably move on a surface thereof, and once the contacts 11*a* and 11*b* come into contact with the corresponding device-side electrodes 40*a* and 40*b*, the connector-equipped cable is completely connected to the device.

However, when the contacts 11*a* and 11*b* slidably move on the paddle card substrate 200, a base, which is not covered with the device-side electrodes 40*a* and 40*b* and is thus exposed on the surface of the paddle card substrate 200, may be damaged or scraped.

Thus, it is an object of the invention to provide a connector and a connector-equipped cable that can prevent a base of the paddle card substrate exposed on a surface from being damaged or scraped when the paddle card substrate is connected to device.

According to an embodiment of the invention, a connector for being arranged at an end of a cable comprises:

- a paddle card substrate for electrically connecting the cable to a connected device;
- a plurality of device-side electrodes that are formed at an end portion of the paddle card substrate in a plurality of rows in an insertion direction into the device and are to be electrically connected to the device; and
- a metal protective portion formed between the device-side electrodes adjacent in the insertion direction into the device to protect a surface of the paddle card substrate, wherein the protective portion comprises a plurality of metal protective pads that are spaced from each other at a predetermined distance in the insertion direction.

EFFECTS OF THE INVENTION

According to an embodiment of the invention, a connector and a connector-equipped cable can be provided that can prevent a base of the paddle card substrate exposed on a surface from being damaged or scraped when the paddle card substrate is connected to device.

DETAILED DESCRIPTION OF THE PREFERRED EMBODIMENTS

First Embodiment

Figure 1:
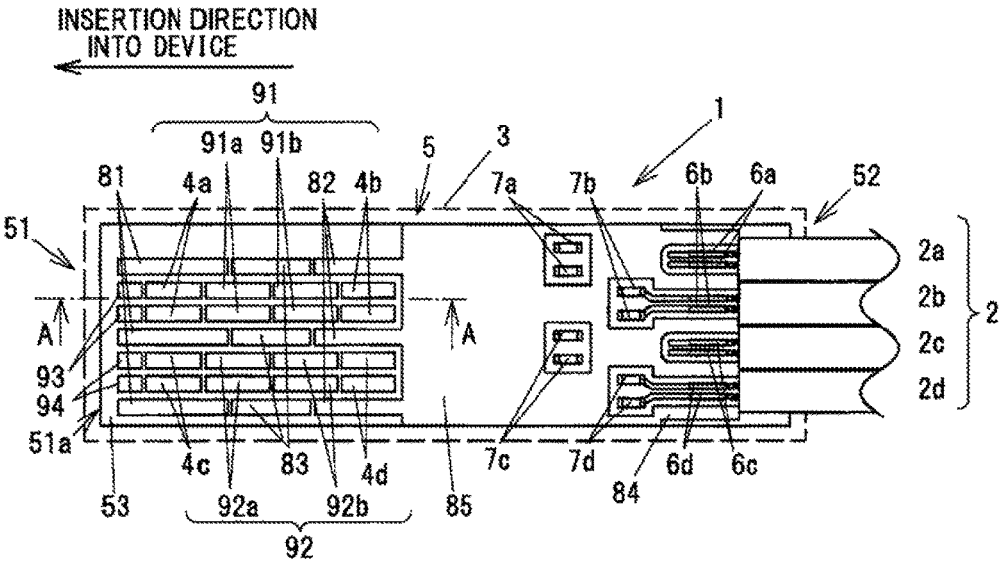
FIG. 1 is a plan view showing a connector-equipped cable in the first embodiment of the present invention.

The first embodiment of the invention will be described with reference to FIG. 1. FIG. 1 is a plan view showing a connector-equipped cable 1 in the first embodiment of the invention.

As shown in FIG. 1, the connector-equipped cable 1 is provided with a cable 2 having plural differential signal transmission cables 2*a*, 2*b*, 2*c* and 2*d*, connectors 3 provided at both ends of the cable 2, and paddle card substrates 5 each of which is formed of a multilayer substrate electrically connecting the differential signal transmission cables 2 to device, is incorporated in the connector 3 and is configured that first to fourth device-side electrodes 4*a* to 4*d* to be electrically connected a connected device (not shown) are formed at one end 51 of a base 53 and the differential signal transmission cables 2 are connected to another end 52.

In the first embodiment, the connector-equipped cable 1 configured to be able to transmit and receive on two channels will be described. In this case, four differential signal transmission cables 2*a*, 2*b*, 2*c* and 2*d* in total, two for transmission and two for reception, are provided. The connector-equipped cable 1 is used for, e.g., transmitting and receiving signals of 25 Gbps.

Cable-connecting electrodes 6*a* electrically connected to the differential signal transmission cable 2*a*, cable-connecting electrodes 6*b* electrically connected to the differential signal transmission cable 2*b*, cable-connecting electrodes 6*c* electrically connected to the differential signal transmission cable 2*c* and cable-connecting electrodes 6*d* electrically connected to the differential signal transmission cable 2*d* are formed at the other end 52 (an end on a side on which the cable 2 is connected) of the paddle card substrate 5 (the base 53).

Coupling capacitors 7*a* are connected, via an inner layer of the multilayer substrate, to the cable-connecting electrodes 6*a* on a side opposite to the side on which the differential signal transmission cable 2*a* is connected. Coupling capacitors 7*b* are connected to the cable-connecting electrodes 6*b* on a side opposite to the side on which the differential signal transmission cable 2*b* is connected. Coupling capacitors 7*c* are connected, via the inner layer of the multilayer substrate, to the cable-connecting electrodes 6*c* on a side opposite to the side on which the differential signal transmission cable 2*c* is connected. Coupling capacitors 7*d* are connected to the cable-connecting electrodes 6*d* on a side opposite to the side on which the differential signal transmission cable 2*d* is connected.

Each coupling capacitor 7*a* is arranged so that a terminal opposite to the terminal connected to the cable-connecting electrode 6*a* is connected to the first device-side electrode 4*a* via the inner layer of the multilayer substrate. Each coupling capacitor 7*b* is arranged so that a terminal opposite to the terminal connected to the cable-connecting electrode 6*b* is connected to the second device-side electrode 4*b* via the inner layer of the multilayer substrate. Each coupling capacitor 7*c* is arranged so that a terminal opposite to the terminal connected to the cable-connecting electrode 6*c* is connected to the third device-side electrode 4*c* via the inner layer of the multilayer substrate. Each coupling capacitor 7*d* is arranged so that a terminal opposite to the terminal connected to the cable-connecting electrode 6*d* is connected to the fourth device-side electrode 4*d* via the inner layer of the multilayer substrate.

In other words, the first device-side electrodes 4*a* are connected to the differential signal transmission cable 2*a* via the coupling capacitors 7*a* and the cable-connecting electrodes 6*a*. The second device-side electrodes 4*b* are connected to the differential signal transmission cable 2*b* via the coupling capacitors 7*b* and the cable-connecting electrodes 6*b*. The third device-side electrodes 4*c* are connected to the differential signal transmission cable 2*c* via the coupling capacitors 7*c* and the cable-connecting electrodes 6*c*. The fourth device-side electrodes 4*d* are connected to the differential signal transmission cable 2*d* via the coupling capacitors 7*d* and the cable-connecting electrodes 6*d*.

The device-side electrodes 4*a*, 4*b*, 4*c* and 4*d* are formed at the one end 51 of the paddle card substrate 5 and are lined up in plural rows in an insertion direction into device. The first device-side electrodes 4*a* and the third device-side electrodes 4*c* are formed at positions located at a predetermined distance D1 away from an end face 51*a* of the one end 51 of the paddle card substrate in the insertion direction into the device and are aligned in a row parallel to the end face 51*a*. The second device-side electrodes 4*b* and the fourth device-side electrodes 4*d* are formed at positions located at a predetermined distance D2 away from the end face 51*a* of the one end of the paddle card substrate in the insertion direction into the device and are aligned in a row parallel to the end face 51*a*. D2 is greater than D1, so the second device-side electrodes 4*b* and the fourth device-side electrodes 4*d* are located at a farther distance from the end face 51*a* of the one end 51 of the paddle card substrate in the insertion direction into the device than the first device-side electrodes 4*a* and the third device-side electrodes 4*c*. In other words, the first device-side electrodes 4*a* and the third device-side electrodes 4*c* form an electrode group in the first row, and the second device-side electrodes 4*b* and the fourth device-side electrodes 4*d* form an electrode group in the second row.

Facing end faces of the first device-side electrodes 4*a* and the second device-side electrodes 4*b* are spaced apart by, e.g., a distance D3 of not less than 2.0 mm. Likewise, facing end faces of the third device-side electrodes 4*c* and the fourth device-side electrodes 4*d* are spaced apart by, e.g., the distance D3 of not less than 2.0 mm.

A ground pattern, a power electrode (not shown) and a control signal electrode (not shown), etc., as well as the device-side electrodes 4*a*, 4*b*, 4*c* and 4*d*, are formed and aligned on a surface of the paddle card substrate 5 at the one end 51, and a card edge connector is thereby formed.

The ground pattern is composed of a first ground pattern 81 formed to sandwich the first device-side electrodes 4*a* and the third device-side electrodes 4*c*, a second ground pattern 82 formed to sandwich the second device-side electrodes 4*b* and the fourth device-side electrodes 4*d*, a third ground pattern 83 formed between the first ground pattern 81 and the second ground pattern 82, a fourth ground pattern 84 formed to sandwich the cable-connecting electrodes 6*a*, 6*b* and 6*c*, and a fifth ground pattern 85 formed on transmission paths between the first to fourth device-side electrodes 4*a* to 4*d* and the cable-connecting electrodes 6*a*, 6*b*, 6*c* and 6*d*.

The second ground pattern 82, the fourth ground pattern 84 and the fifth ground pattern 85 are continuous and form an integral pattern. The first ground pattern 81 and the third ground pattern 83 are not connected to the other patterns and do not form the integral pattern.

First protective portions 91 made of a metal are formed on the surface of the paddle card substrate 5 between the first device-side electrodes 4*a* and the second device-side electrodes 4*b*. Second protective portion 92 made of a metal are also formed on the surface of the paddle card substrate 5 between the third device-side electrodes 4*c* and the fourth device-side electrodes 4*d*. Each first protective portion 91 is composed of two protective pads 91*a* and 91*b* which are spaced at a predetermined distance in the insertion direction of the paddle card substrate into the device. Each second protective portion 92 is composed of two protective pads 92*a* and 92*b* which are spaced at a predetermined distance in the insertion direction of the paddle card substrate into the device. The protective pads 91*a* and 91*b* are spaced from each other at a distance D4 of not less than 0.05 mm and not more than 0.25 mm, and so are the protective pads 92*a* and 92*b*. When D4 is less than 0.5 mm, it is difficult to form the protective pads 91*a*, 91*b*, 92*a* and 92*b* in manufacturing. When D4 is more than 0.25 mm, the distances between the protective pads 91*a* and 91*b* and between the protective pads 92*a* and 92*b* are too large and a function of protecting the surface of the paddle card substrate 5 is not sufficient.

Third protective portions 93 made of a metal are formed between the end face 51*a* of the paddle card substrate 5 and the first device-side electrodes 4*a*. Fourth protective portions 94 made of a metal are formed between the end face 51*a* of the paddle card substrate 5 and the third device-side electrodes 4*c*.

The first protective portions 91, the second protective portions 92, the third protective portions 93 and the fourth protective portions 94 are not electrically connected to any device-side electrodes or ground patterns, and thus are electrically floating from other electrodes.

The first protective portions 91, the second protective portions 92, the third protective portions 93 and the fourth protective portions 94 are formed of the same material as the first device-side electrodes 4*a*, the second device-side electrodes 4*b*, the third device-side electrodes 4*c* and the fourth device-side electrodes 4*d*. Use of the same material allows the first protective portions 91, the second protective portions 92, the third protective portions 93 and the fourth protective portions 94 to be simultaneously formed in the process of forming the device-side electrodes 4*a*, 4*b*, 4*c* and 4*d* on the base 53 of the paddle card substrate 5.

Figure 2:
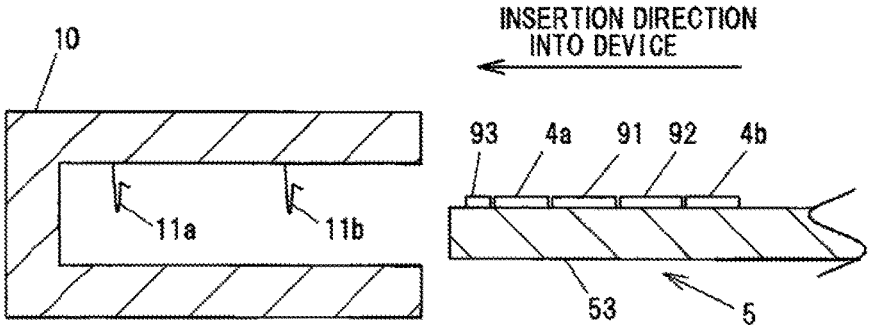
FIG. 2 is a cross sectional view showing a paddle card taken along a line A-A in FIG. 1 and a diagram illustrating a connector housing provided on device.

Next, movement when inserting the connector-equipped cable 1 into a connector housing 10 provided on device will be described with reference to FIG. 2. FIG. 2 shows the paddle card 5 in a cross sectional taken along the line A-A in FIG. 1 and the connector housing 10 provided on device. In FIG. 2, the fifth ground pattern and the cable 2, etc., are omitted.

When connecting the connector-equipped cable 1 to device, the connector-equipped cable 1 is inserted into the connector housing 10 by sliding to bring the first device-side electrodes 4*a* into contact with first contacts 11*a* provided on the inner side of the connector housing 10 and to bring the second device-side electrodes 4*b* into contact with second contacts 11*b* provided on the near side of the connector housing 10. The first device-side electrodes 4*a* and the second device-side electrodes 4*b* are respectively brought into contact with and electrically connected to the first contacts 11*a* and the second contacts 11*b*.

The first contacts 11*a* slidably move on the third protective portions 93 in the course of sliding on the paddle card substrate 5 to the positions where the first contacts 11*a* come into contact with the first device-side electrodes 4*a*. The second contacts 11*b* slidably move on the protective portions 93, the first device-side electrodes 4*a* and the protective pads 91*a* and 91*b* of the first protective portions 91 in the course of sliding on the paddle card substrate 5 to the positions where the second contacts 11*b* come into contact with the second device-side electrodes 4*b*. Since the protective portions 93 and the protective pads 91*a* and 91*b* are provided on the paddle card substrate 5, the first contacts 11*a* and the second contacts 11*b* are prevented from slidably moving on the base 53 exposed on the surface and thus do not damage or scrape the surface. Likewise, since the fourth protective portions 94 and the second protective portions 92 are provided on the paddle card substrate 5, other contacts (not shown) inside the connector housing 10 are prevented from slidably moving on the base 53 exposed on the surface and thus do not damage or scrape the surface, even though the explanation thereof is omitted.

Figure 3:
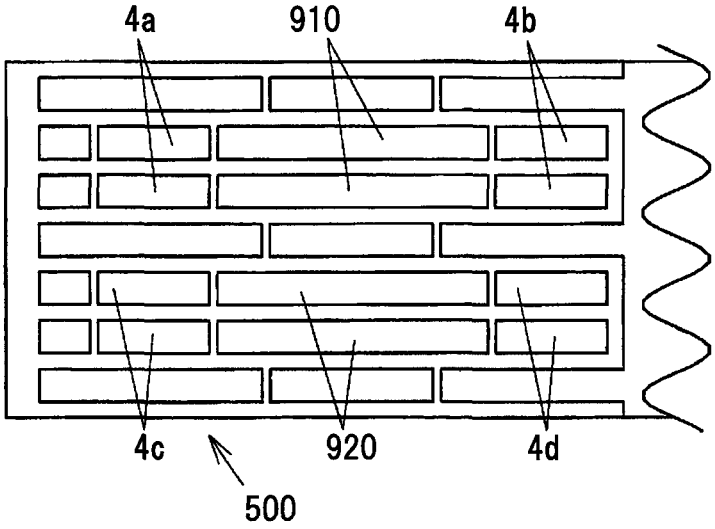
FIG. 3 is a diagram illustrating one end of a paddle card substrate in Comparative Example 1.

Next, the first protective portion 91 and the second protective portion 92 will be further described using Comparative Example 1. FIG. 3 is a diagram illustrating one end of a paddle card substrate 500 in Comparative Example 1. Unlike the paddle card substrate 5 in the first embodiment, the paddle card substrate 500 in Comparative Example 1 is configured that each of first protective portions 910 and second protective portions 920 is formed of one protective pad. The remaining configuration of Comparative Example 1 is the same as the first embodiment.

Figure 4A:
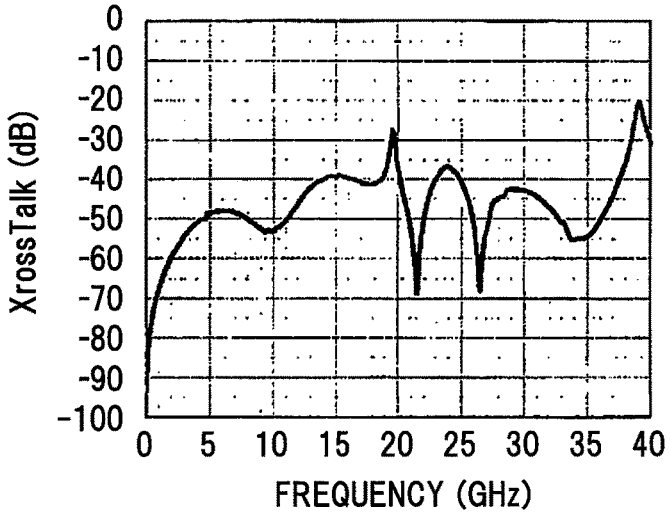
FIG. 4A is a diagram illustrating a simulation result of an effect of crosstalk on the paddle card substrate in the first embodiment.
Figure 4B:
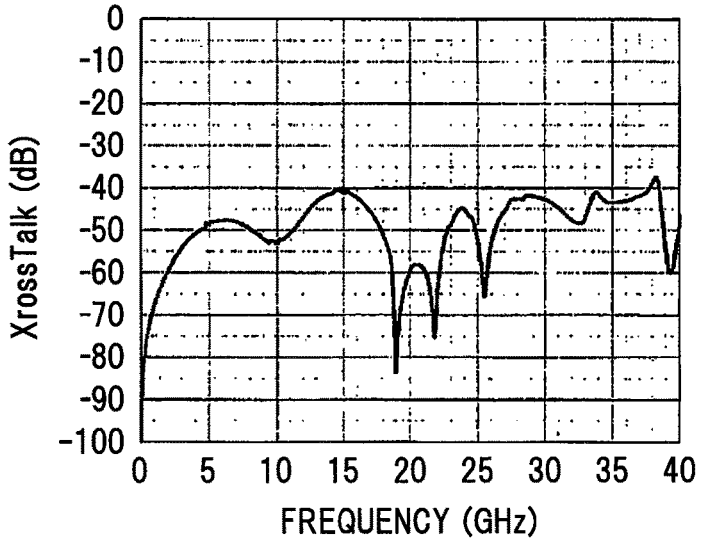
FIG. 4B is a diagram illustrating a simulation result of an effect of crosstalk on the paddle card substrate in Comparative Example 1.

An effect of a signal applied to each of the device-side electrodes 4*a*, 4*b*, 4*c* and 4*d* on the other device-side electrodes 4*a*, 4*b*, 4*c* and 4*d* adjacent thereto was examined on the paddle card substrate 5 of the first embodiment and the paddle card substrate 500 of Comparative Example 1. In detail, a signal appearing at the first device-side electrode 4*a* when applying a signal to the second device-side electrode 4*b* was simulated using electromagnetic analysis. In other words, an effect of crosstalk on the first device-side electrode 4*a* when applying a signal to the second device-side electrode 4*b* was simulated. The simulation results are shown in FIGS. 4A and 4B. FIG. 4A shows a simulation result of an effect of crosstalk on the paddle card substrate 5 in the first embodiment and FIG. 4B shows a simulation result of an effect of crosstalk on the paddle card substrate 500 in Comparative Example 1.

As shown in the simulation results of FIGS. 4A and 4B, crosstalk peaks appear at bandwidths of around 20 GHz and around 40 GHz in the paddle card substrate 500 of Comparative Example 1. In the paddle card substrate 5 of the first embodiment, the crosstalk peaks are smaller than those in Comparative Example 1 and the value of integrated crosstalk relative to frequency is small. This shows that the effect of crosstalk is smaller in the first embodiment than in Comparative Example 1. In other words, the effect of crosstalk in the connector-equipped cable 1 of the first embodiment is reduced by forming the first protective portion 91 (the second protective portion 92) using two (plural) members.

A resin member may be provided in a gap between the protective pads 91*a* and 91*b* of the first protective portion 91. The resin member preferably has a higher abrasion resistance and a lower coefficient of friction than the base 53 of the paddle card substrate 5. The base 53 of the paddle card substrate 5 is formed of, e.g., FR4 (Flame Retardant 4). The resin member is formed of, e.g., Teflon (registered trademark) resin. By having the resin member in a gap between the protective pads 91*a* and 91*b*, the paddle card substrate 5 can prevent the first contacts 11*a* and the second contacts 11*b* from slidably moving on the base 53 exposed on the surface. A resin member may be also provided in a gap between the protective pads 92*a* and 92*b* of the second protective portion 92 in the same manner.

The first ground pattern 81, the second ground pattern 82 and the third ground pattern 83 may be formed as one continuous pattern.

Effects of the First Embodiment

The connector 3 and the connector-equipped cable 1 in the first embodiment are configured that the first and second protective portions 91 and 92 made of a metal are formed on the surface of the paddle card substrate 5 between the first device-side electrodes 4*a* and the second device-side electrodes 4*b* and between the third device-side electrodes 4*c* and the fourth device-side electrodes 4*d*. This prevents damage or scrape on the base 53 exposed on the surface of the paddle card substrate 5 when connecting the paddle card substrate 5 to device.

In addition, since the first protective portion 91 (the second protective portion 92) is formed of plural metal protective pads 91*a* and 91*b* (92*a* and 92*b*) which are spaced at a predetermined distance in the insertion direction of the paddle card substrate 5 into the device, it is possible to reduce the effect of crosstalk between adjacent device-side electrodes as compared to when each of the first protective portion 91 and the second protective portion 92 is formed of one protective pad.

Second Embodiment

Figure 5:
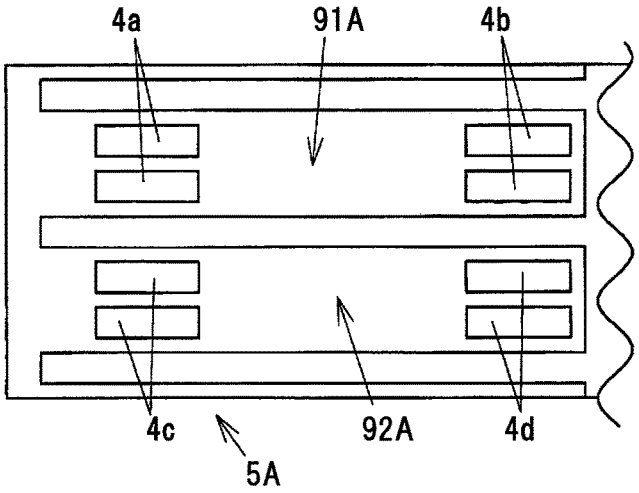
FIG. 5 is a diagram illustrating a paddle card substrate 5A which constitutes a connector-equipped cable in the second embodiment of the invention.

Next, the second embodiment of the invention will be described with reference to FIG. 5. The difference between the connector-equipped cable 1 in the first embodiment and a connector-equipped cable in the second embodiment is in a configuration at one end of the paddle card substrate. Therefore, the configuration of one end of a paddle card substrate 5A in the second embodiment will be described below. FIG. 5 is a diagram illustrating the paddle card substrate 5A which constitutes a connector-equipped cable in the second embodiment of the invention. The same constituent elements as those of the paddle card substrate 5 in the first embodiment are denoted by the same reference numerals, and the explanation thereof will be omitted.

The paddle card substrate 5A in the second embodiment is configured that a non-metallic first protective portion 91A is formed between the first device-side electrodes 4*a* and the second device-side electrodes 4*b* in place of metal protective portions. Likewise, the paddle card substrate 5A is configured that a non-metallic second protective portion 92A is formed between the third device-side electrodes 4*c* and the fourth device-side electrodes 4*d* in place of metal protective portions. The first protective portion 91A and the second protective portion 92A are formed of, e.g., resin or ceramic, etc. The first protective portion 91A and the second protective portion 92A are preferably formed of a material which has a higher abrasion resistance and a lower coefficient of friction than the base 53 of the paddle card substrate 5A.

An effect of a signal applied to each of the device-side electrodes 4*a*, 4*b*, 4*c* and 4*d* on the other device-side electrodes 4*a*, 4*b*, 4*c* and 4*d* adjacent thereto was examined on the paddle card substrate 5A of the second embodiment in the same manner as the first embodiment. In detail, a signal appearing at the first device-side electrode 4*a* when applying a signal to the second device-side electrode 4*b* was simulated using electromagnetic analysis. In other words, an effect of crosstalk on the first device-side electrode 4*a* when applying a signal to the second device-side electrode 4*b* was simulated. The simulation result is shown in FIG. 6.

Figure 6:
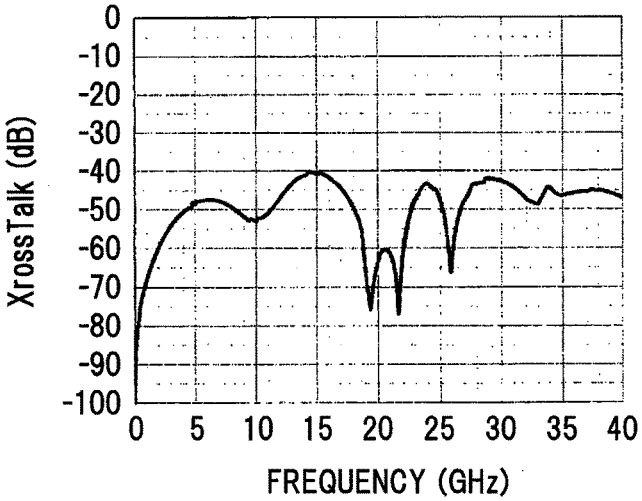
FIG. 6 is a diagram illustrating a simulation result of an effect of crosstalk on the paddle card substrate in the second embodiment.
Figure 7:
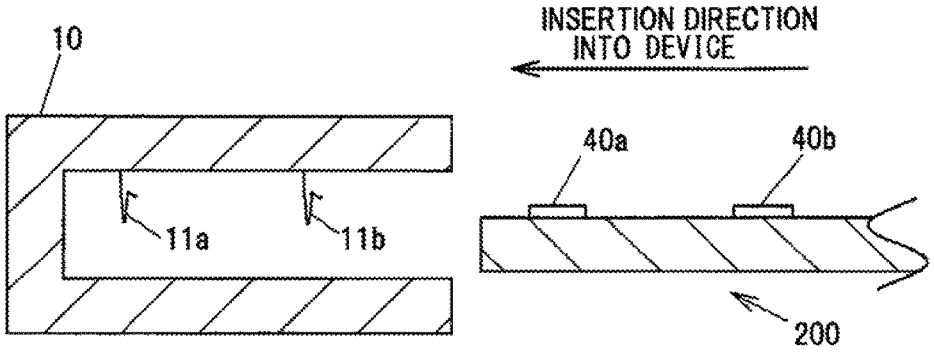
FIG. 7 is an explanatory diagram illustrating a prior art.

As shown in the simulation results of FIGS. 6 and 4B, crosstalk peaks appear at bandwidths of around 20 GHz and around 40 GHz in the paddle card substrate 500 of Comparative Example 1. In the paddle card substrate 5A of the second embodiment, the crosstalk peaks are smaller than those in Comparative Example 1 and the value of integrated crosstalk relative to frequency is small. This shows that the effect of crosstalk is smaller in the second embodiment than in Comparative Example 1. In other words, the effect of crosstalk in the connector-equipped cable of the second embodiment is reduced by forming the first protective portion 91 (the second protective portion 92) using a non-metallic member.

Effects of the Second Embodiment

The connector and the connector-equipped cable in the second embodiment are configured that the non-metallic first and second protective portions 91A and 92A are formed on the surface of the paddle card substrate 5A between the first device-side electrodes 4*a* and the second device-side electrodes 4*b* and between the third device-side electrodes 4*c* and the fourth device-side electrodes 4*d*. This prevents damage or scrape on the base 53 exposed on the surface of the paddle card substrate 5 when connecting the paddle card substrate 5A to device.

In addition, since the first protective portion 91A and the second protective portion 92A are formed of non-metallic members, it is possible to reduce the effect of crosstalk between adjacent device-side electrodes.

Although the embodiments of the invention have been described, the invention according to claims is not to be limited to the embodiments. Further, please note that all combinations of the features described in the embodiments are not necessary to solve the problem of the invention.

For example, although an example in which device-side electrodes and protective portions, etc., are formed on one surface of the paddle card substrate 5 or 5A has been described in the first and second embodiments, the device-side electrodes and the protective portions, etc., may be formed also on the other surface in the same manner.

REFERENCE SIGNS LIST

1 . . . Connector-Equipped Cable
2 . . . Cable
3 . . . Connector
4*a* . . . First Device-Side Electrode
4*b* . . . Second Device-Side Electrode
4*c* . . . Third Device-Side Electrode
4*d* . . . Fourth Device-Side Electrode
5, 5A . . . Paddle Card Substrate
91 . . . First Protective Portion
92 . . . Second Protective Portion

What is claimed is:

1. A connector for being arranged at an end of a cable, the connector comprising:

a paddle card substrate for electrically connecting the cable to a connected device;

a plurality of device-side electrodes that are formed at an end portion of the paddle card substrate in a plurality of rows in an insertion direction into the device and are to be electrically connected to the device; and a protective portion formed between the device-side electrodes adjacent in the insertion direction into the device to protect a surface of the paddle card substrate;

wherein the protective portion comprises a plurality of metal protective pads that are spaced from each other at a predetermined distance in the insertion direction;

wherein the protective portion comprises the two protective pads that are spaced from each other at a distance of not less than 0.05 mm and not more than 0.25 mm in the insertion direction.

2. The connector according to claim 1, wherein the protective portion further comprises a resin member provided between the plurality of spaced protective pads.

3. A connector-equipped cable, comprising:

a cable; and a connecter provided at an end of the cable, wherein the connector comprises a paddle card substrate for electrically connecting the cable to a connected device, a plurality of device-side electrodes that are formed at an end portion of the paddle card substrate in a plurality of rows in an insertion direction into the device and are to be electrically connected to the device, and a metal protective portion formed between the device-side electrodes adjacent in the insertion direction into the device to protect a surface of the paddle card substrate, and wherein the protective portion comprises a plurality of protective pads that are spaced from each other at a predetermined distance in the insertion direction;

wherein the protective portion has a higher abrasion resistance and a lower coefficient of friction than a base of the paddle card substrate.

4. A connector for being arranged at an end of a cable, the connector comprising:

a paddle card substrate for electrically connecting the cable to a connected device;

a plurality of device-side electrodes that are formed at an end portion of the paddle card substrate in a plurality of rows in an insertion direction into the device and are to be electrically connected to the device; and a non-metallic protective portion formed between the device-side electrodes adjacent in the insertion direction into the device to protect a surface of the paddle card substrate;

wherein the protective portion has a higher abrasion resistance and a lower coefficient of friction than a base of the paddle card substrate.

* * * * *